US007214120B2

(12) United States Patent
Kaye et al.

(10) Patent No.: US 7,214,120 B2
(45) Date of Patent: May 8, 2007

(54) BRASSIERE HAVING A SPACER FABRIC AND A METHOD OF MAKING SAME

(75) Inventors: Joanne Kaye, New York, NY (US); Michael D Abbott, Statesville, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 0 days.

(21) Appl. No.: 10/782,370

(22) Filed: Feb. 19, 2004

(65) Prior Publication Data

US 2004/0224603 A1 Nov. 11, 2004

Related U.S. Application Data

(60) Provisional application No. 60/448,647, filed on Feb. 19, 2003.

(51) Int. Cl.
*A41C 10/00* (2006.01)
*A41C 12/00* (2006.01)

(52) U.S. Cl. ..... 450/39; 450/92

(58) Field of Classification Search ..... 450/55–57, 450/39, 1, 44, 47, 49, 51, 52, 90, 92, 93; 2/267, 268, 244, 246; 156/245; 264/257, 264/258, 291, 292, 294, 320, 321, 145, 148, 264/152–155, 157, 160, 163
See application file for complete search history.

(56) References Cited

U.S. PATENT DOCUMENTS 507,373 A 10/1893 Lendry
1,861,003 A 5/1932 Foster
2,033,065 A 3/1936 Galligan
2,301,499 A 11/1942 Amyot
2,420,575 A 5/1947 Treadwell
2,429,680 A 10/1947 Goddard
2,445,767 A 7/1948 Dickerson
2,482,255 A 9/1949 Florsheim, Jr.
2,511,641 A 6/1950 Kuhn
2,524,620 A 10/1950 Cadous
2,579,365 A 12/1951 Conde
2,611,898 A 3/1952 Laird
D167,497 S 8/1952 Conde
2,628,928 A 2/1953 Cadous
D168,980 S 3/1953 Whitman
2,637,041 A 5/1953 Bachmann
2,659,085 A 11/1953 Ericson
2,686,312 A 8/1954 Schmidt (Continued)

OTHER PUBLICATIONS

International Search Report corresponding to PCT International Application No. PCT/US2004/004889.

*Primary Examiner*—Gloria M. Hale
(74) *Attorney, Agent, or Firm*—Ohlandt, Greeley, Ruggiero & Perle, L.L.P.

(57) ABSTRACT

A brassiere for supporting a wearer's breasts has breast cups with each of the breast cups connected to a central panel therebetween. The brassiere has a pair of side panels. Each side panel is connected to a different one of the pair of breast cups. The breast cups have a first fabric layer, a second fabric layer and a third fabric layer that is between the first fabric layer and the second fabric layer. The third fabric layer provides breathability and support to the wearer's breasts.

19 Claims, 4 Drawing Sheets

U.S. PATENT DOCUMENTS

| | | | | | |
|---|---|---|---|---|---|
| 2,697,832 | A | | 12/1954 | Stich | |
| 2,698,940 | A | | 1/1955 | Dombek | |
| 2,772,418 | A | | 12/1956 | Spanel | |
| 2,793,369 | A | | 5/1957 | Panighini | |
| 2,797,415 | A | | 7/1957 | Spanel et al. | |
| 2,949,115 | A | | 8/1960 | Phillips | |
| 2,992,646 | A | | 7/1961 | Weinberg | |
| 3,077,196 | A | | 2/1963 | Paxton | |
| 3,101,717 | A | | 8/1963 | Korman | |
| 3,187,753 | A | | 6/1965 | Hershon | |
| 3,890,987 | A | | 6/1975 | Nobbs | |
| 3,981,310 | A | | 9/1976 | Donaghy | |
| 4,073,299 | A | | 2/1978 | Murata | |
| 4,080,416 | A | * | 3/1978 | Howard | 264/258 |
| 4,091,819 | A | * | 5/1978 | Huber et al. | 450/55 |
| 4,372,321 | A | * | 2/1983 | Robinson | 450/39 |
| 4,572,195 | A | | 2/1986 | Hyams | |
| D287,180 | S | | 12/1986 | DiTullio | |
| 4,983,140 | A | | 1/1991 | Gimble | |
| 5,154,659 | A | * | 10/1992 | Gluckin | 450/39 |
| 5,244,432 | A | | 9/1993 | Moy et al. | |
| 5,385,036 | A | | 1/1995 | Spillane et al. | |
| 5,447,462 | A | * | 9/1995 | Smith et al. | 450/122 |
| 5,522,892 | A | | 6/1996 | Lin | |
| 5,783,277 | A | | 7/1998 | Rock et al. | |
| 5,820,443 | A | | 10/1998 | Burr | |
| 6,067,660 | A | | 5/2000 | Contini | |
| 6,068,538 | A | | 5/2000 | Alleyne | |
| 6,080,037 | A | | 6/2000 | Lee et al. | |
| 6,110,005 | A | | 8/2000 | Stephenson et al. | |
| 6,125,472 | A | | 10/2000 | Nakagawa | |
| 6,165,045 | A | | 12/2000 | Miller et al. | |
| 6,174,217 | B1 | * | 1/2001 | Judson | 450/1 |
| 6,299,505 | B1 | * | 10/2001 | Huang | 450/57 |
| 6,306,006 | B1 | * | 10/2001 | Cheng | 450/57 |
| D453,409 | S | | 2/2002 | Kim | |
| D453,410 | S | | 2/2002 | Kim | |
| 6,375,537 | B1 | | 4/2002 | Janowski | |
| 6,398,620 | B1 | * | 6/2002 | Huang | 450/57 |
| 6,425,800 | B1 | | 7/2002 | Huang | |
| 6,447,365 | B1 | | 9/2002 | Powell et al. | |
| 6,540,585 | B1 | * | 4/2003 | Lee | 450/38 |
| 2002/0124293 | A1 | | 9/2002 | Zeiler | |
| 2002/0162161 | A1 | | 11/2002 | Zeiler | |
| 2003/0033656 | A1 | | 2/2003 | Jaeger | |

* cited by examiner

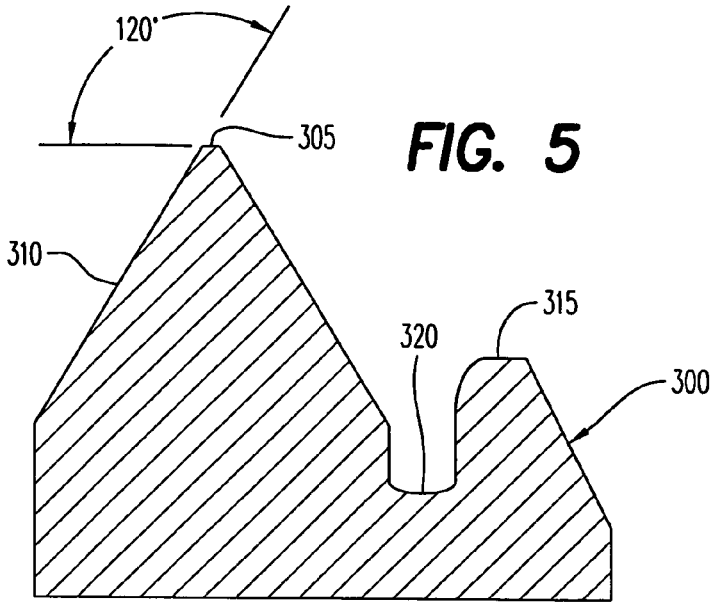
FIG. 5
FIG. 6
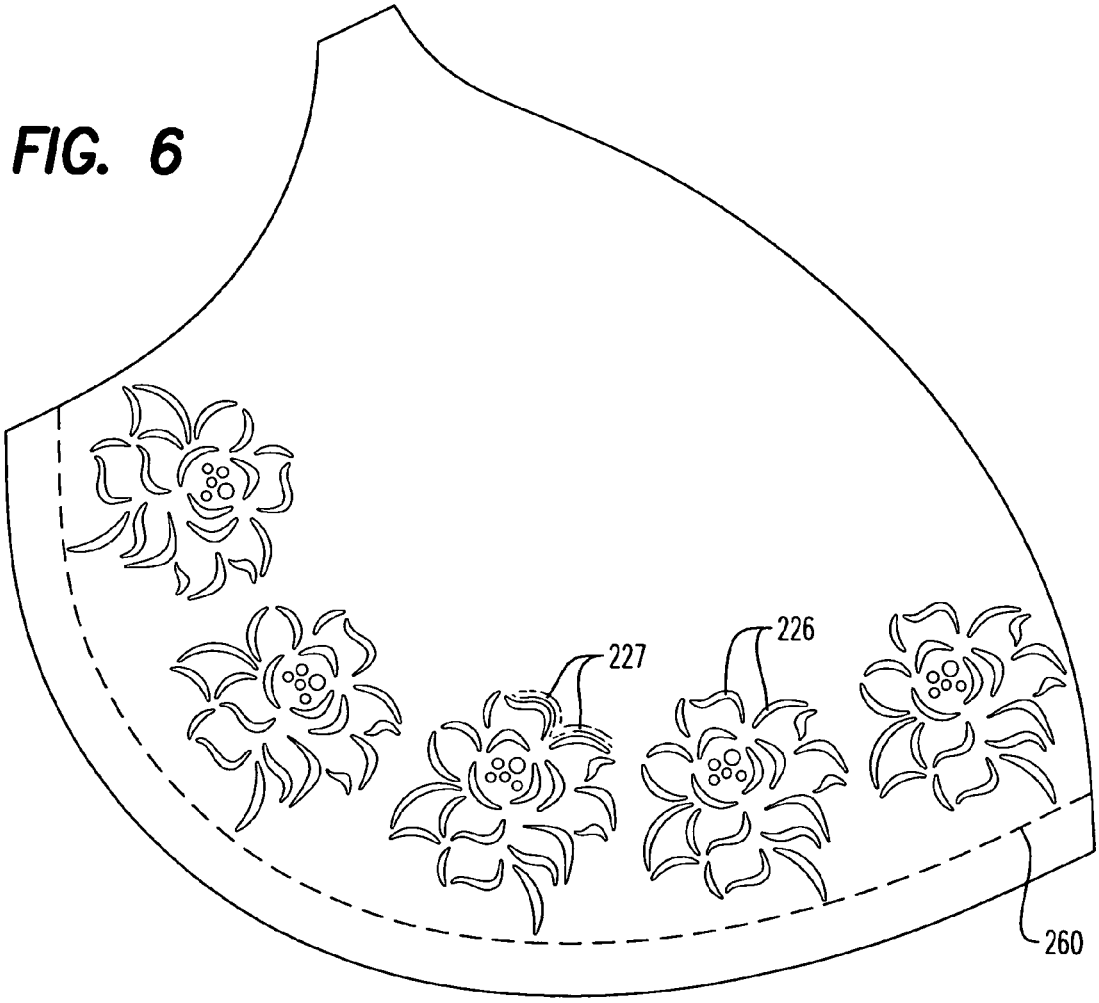

BRASSIERE HAVING A SPACER FABRIC AND A METHOD OF MAKING SAME

CROSS-REFERENCE TO RELATED APPLICATIONS

This application claims priority to U.S. Provisional Patent Application Ser. No. 60/448,647 filed on Feb. 19, 2003.

BACKGROUND OF THE INVENTION

1. Field of the Invention

The present invention relates generally to brassieres. More particularly, the present invention relates to a brassiere having a spacer fabric layer in the breast cups, and a method of making same.

2. Description of the Related Art

A brassiere commonly has a front panel with a pair of breast cups. The brassiere also has a pair of side portions with each side portion being connected to a breast cup on a first end and having a second end for extending about the torso of the wearer. The brassiere further has a fastener for securing the side portions about the wearer. The brassiere may also have a pair of shoulder straps.

Brassieres are worn to provide support to the breast of the wearer. Accordingly, it has become common to provide support brassieres. These support brassieres have multiple layers in the breast cups. Such brassieres commonly have one or more breast cup layers. These layers have an inner layer for providing a soft feel against the wearer's breast, an outer layer for providing a finished look to the brassiere, and a support material positioned between the layers. Preferably, the inner and outer breast cup layers are connected at their peripheral edges to enclose the support material. Materials used for breast cup support material include, polyester or fiberfill, spandex such as LYCRA plastic, silicon, and molded foam.

While support brassieres are functional and provide much needed support and comfort to the wearer, the support materials limit air circulation around the breast area, and constrict the breast tissues. Thus, such brassieres, when worn for an extended period of time, will cause discomfort to the wearer because air does not circulate easily through commonly used support materials, such as molded foam. The wearer may feel uncomfortably warm or sweaty, especially during exercise.

Molded spacer foam having perforations has been employed for improving breathability and air circulation. While such perforated foam does improve circulation, circulation is still somewhat limited due to the proximity of the cells that make up the foam material.

A spacer fabric can provide support and air circulation. However, spacer fabrics have not been employed for use in a brassiere, perhaps because the known methods of perforation or pattern forming weaken the spacer fabric, causing it to tear or fray. For example, the perforation process subjects the spacer fabric to shearing-induced stresses that may cause an edge of a perforation to fray or tear.

Therefore, a need exists for a brassiere that has a perforated spacer fabric for increasing breathability and comfort, but that does not weaken the spacer fabric so that the spacer fabric tears or frays along the edges of the perforations.

SUMMARY OF THE INVENTION

It is an object of the present invention to provide a brassiere having increased support in the breast cups.

It is another object of the present invention to provide a brassiere with breathability in the breast cup areas, especially in the breast cups.

It is still another object of the present invention to provide a brassiere with a molded breast cup with a spacer fabric.

It is still yet another object of the present invention to provide a brassiere with a molded breast cup with a spacer fabric and having an inner fabric portion and an outer fabric portion secured by sewing to or about the spacer fabric.

It is yet another object of the present invention to provide a molded breast cup with a molded spacer fabric having one or more breathable structures.

It is yet another object of the present invention to provide a molded breast cup with a molded spacer fabric having perforations and a pattern formed by the perforations therein.

It is a further object of the present invention to provide a method for making a breast cup having a pattern of perforations formed in a spacer fabric so that the spacer fabric does not tear or fray.

It is yet a further object of the present invention to provide a method for making a breast cup from a spacer fabric with a desired pattern of perforations formed in the spacer fabric.

These and other objects and advantages of the present invention are provided by a brassiere having breast cups with a molded spacer fabric or layer that can receive perforations or air pockets, preferably as part of a desired pattern, and having an inner fabric layer and, preferably, an outer fabric layer that are sewn or connected to/or connected about the molded spacer layer on separate sides thereof. The spacer fabric with perforations allows air circulation in the breast area.

BRIEF DESCRIPTION OF THE DRAWINGS

The foregoing will be more apparent from the following detailed explanation of the preferred embodiments of the invention in connection with the accompanying drawings.

FIG. 5 is a sectional view of a cutter for perforating the molded spacer portion according to the present invention; and FIG. 6 is a pictorial view of the molded breast cup.

DETAILED DESCRIPTION OF THE INVENTION

Figure 1:
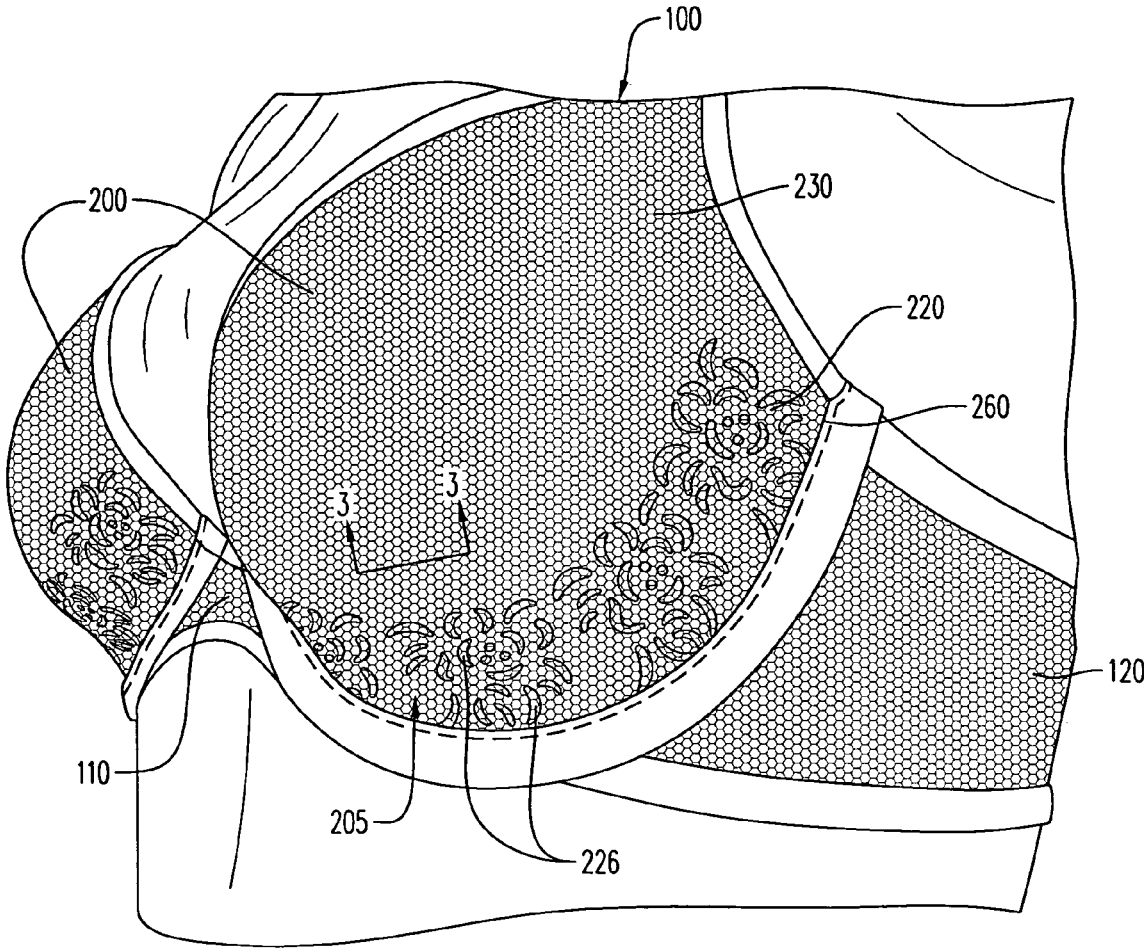
FIG. 1 illustrates a perspective view of a brassiere having breast cups with a perforated molded spacer portion, according to the present invention.
Figure 2:
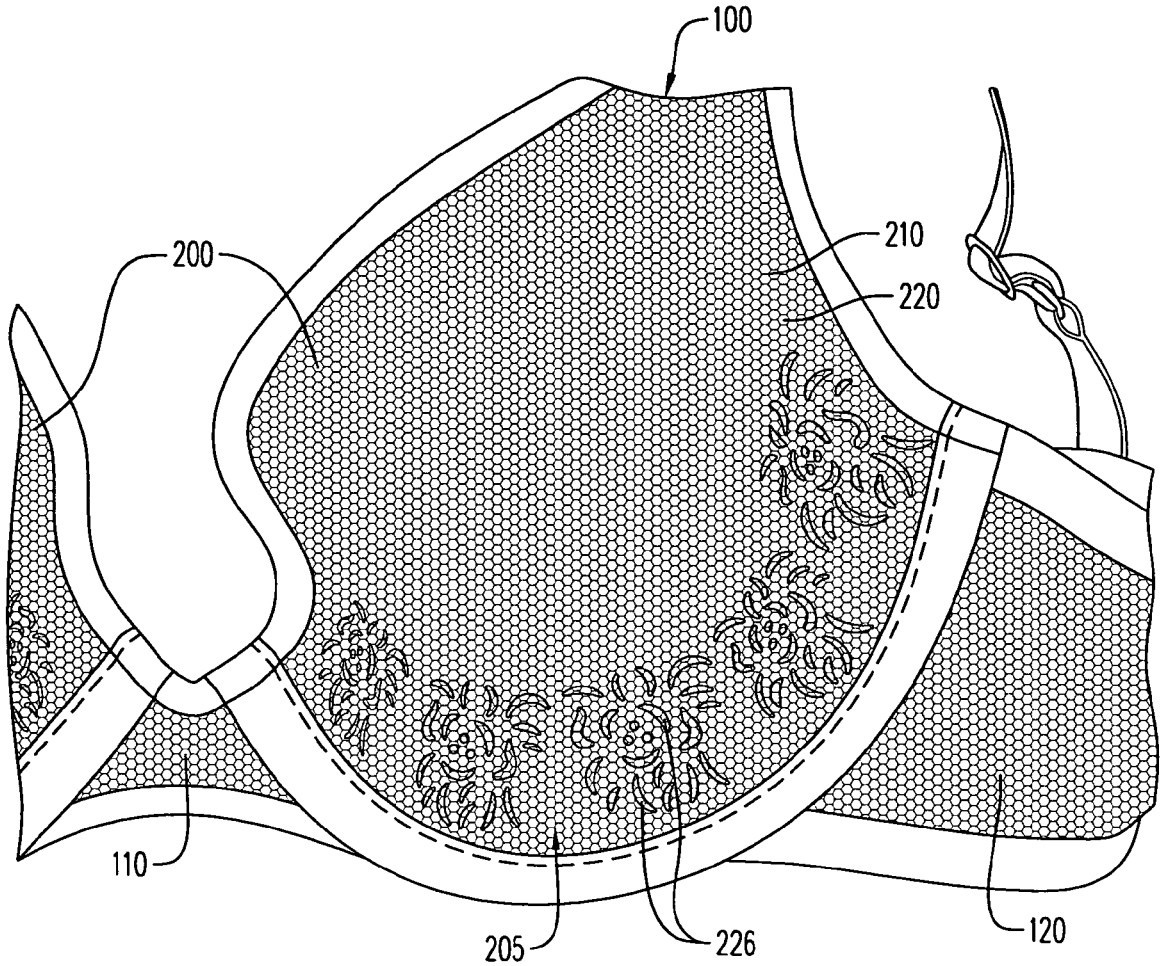
FIG. 2 is a partial rear view of the brassiere of FIG. 1.

Referring to the drawings and, in particular FIGS. 1 and 2, there is provided a brassiere generally represented by reference numeral 100. The brassiere 100 has a pair of breast cups 200, a center gore 110 positioned between the pair of breast cups, and a pair of side panels 120 (only one of which is shown). Each of the pair of side panels 120 is connected to a different one of the pair of breast cups 200.

Figure 3:
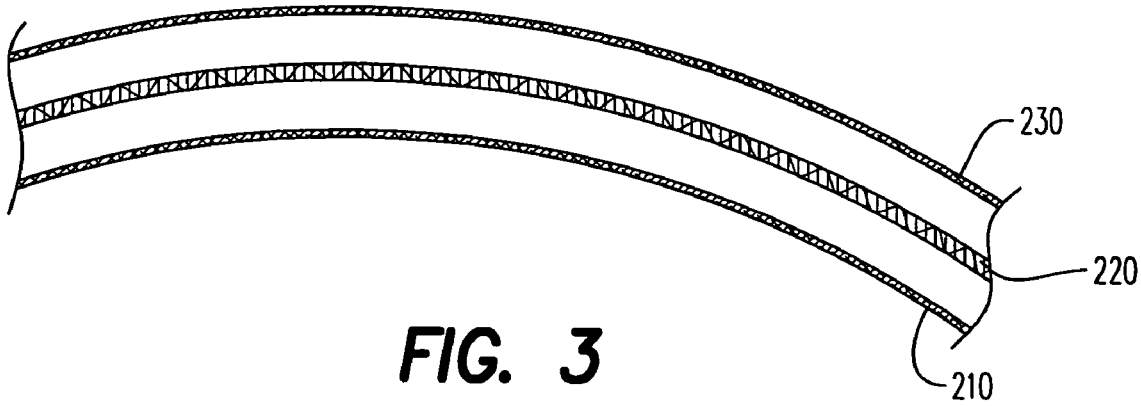
FIG. 3 is an exploded cross section of the brassiere of FIG. 1 along line 3—3.

Referring to FIGS. 1 through 3, each breast cup 200 is preferably a molded cup. Each breast cup 200 has an inner fabric material or layer 210, an outer fabric material or layer 230, and a spacer fabric or layer 220 therebetween. The spacer layer 220 is preferably positioned between the inner layer 210 and the outer layer 230. The layers are arranged such that the pair of breast cups have a first fabric layer, a second fabric layer and a third fabric layer between the first fabric layer and the second fabric layer. The spacer layer 220 can be entirely perforated or only perforated in a portion that preferably is a lower edge 205 of each breast cup 200 as shown in FIGS. 1 through 3. The spacer layer 220, in either embodiment, provides breathability to the wearer's breasts, as well as support to the pair of breast cups 200. Thus, spacer layer 220 provides support and, at a critical portion of the wearer's breasts, breathability, to each breast cup 200.

Preferably, the series of perforations 226 form a horizontally disposed arching pattern at a location of the breast cups 200 where each breast lays. The perforations 226 being shown in FIG. 1 are in the horizontally disposed arching pattern on the breast cup 200 adjacent to the lower edge 205. The perforations 226 are preferably located on a bottommost portion or base of each breast cup 200. These perforations 226 are arranged in the pattern to allow for adequate air circulation and to allow air to cool a portion of the breast cup 200 where the breast lays. The perforations 226 are disposed across the base of each breast cup 200, however one skilled in the art should appreciate that any number or size perforations may be used and is within the scope of the present invention to facilitate cooling of the breast laying in the breast cup 200. Alternatively, the perforations 226 may be disposed at an arc, or portion of the curve of the lower edge 205 of the pair of breast cups 200 to cool the breast in the breast cups.

Figure 4:
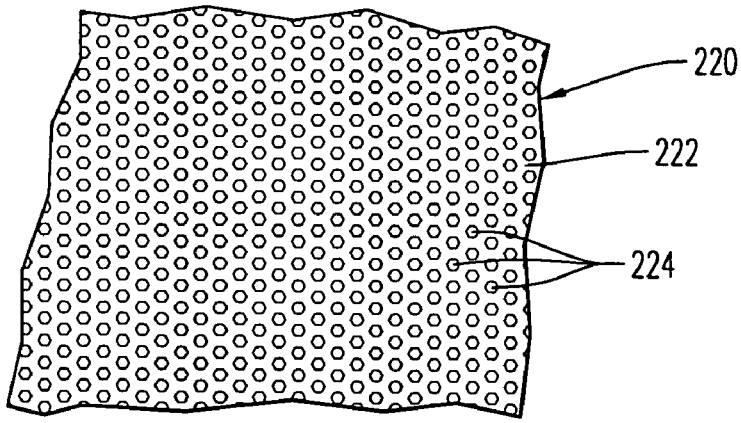
FIG. 4 is a plan view of one surface of the spacer fabric used in the brassiere of FIG. 1.

Referring to FIG. 4, the spacer layer 220 has a spacer material or fabric. The spacer material has a first or outer surface 222 and a second or inner surface (not shown), opposite the outer surface. In a preferred embodiment, the first surface 222 has a series of patterned valleys or dimples 224. The dimples 224 allow for enhanced air circulation, while the inner surface is smooth. In less preferred embodiments, the first or outer surface 222 can have the dimples 224 or be smooth, and the inner surface can have the dimples or be smooth, or any combinations of these features.

As shown in FIGS. 1 and 2, the spacer fabric 220 has a series of perforations 226 that form a floral pattern. These perforations 226 may form any pattern that allows for adequate air circulation. Some examples of such patterns include, but are not limited to, one or more hearts, spirals, letters, a logo, free-form designs, or any combinations thereof. Most preferably, the design is a flower, however one skilled in the art should appreciate that any design may be used and is within the scope of the present invention.

The inner layer 210, which contacts the breasts of the wearer, is made of any known fabric material in the art that is used as the inner surface or lining of a brassiere. Such fabric materials can be mono-filament and/or multi-filaments. Such fabric materials include, but are not limited to, microfiber, cotton, nylon, spandex such as LYCRA power mesh, or any combinations thereof. Preferably, inner layer 210 is made of power mesh. The outer layer 230 is made of any fabric material used as a conventional outer layer of a brassiere. Such conventional outer layer fabric materials, that can be mono-filament and/or multi-filaments, include, but are not limited to, microfiber, cotton, nylon, spandex such as LYCRA®, power mesh, or any combinations thereof. Preferably, the outer layer 230 is made of the power mesh. More preferably, the inner and the outer layers 210, 230 should be made of a material that allows perforations 226 to be visible, thereby enhancing the aesthetics of brassiere 100, and improving the overall breathability of breasts cups 200.

In a less preferred embodiment of the present invention, the brassiere is a two-layer structure in which the spacer fabric 220 is the outer layer, and the second layer is the inner layer 230.

The spacer layer 220 is preferably a spacer fabric or material. Such spacer material can be, but is not limited to, a mono-filament and/or multi filaments. It can be made of polyester, microfiber, cotton, nylon, spandex such as LYCRA, power mesh, or any combinations thereof. Preferably, the spacer material is a multi-filament polyester spandex. As discussed above, in a preferred embodiment, one surface, the outer surface, has a number of dimples 224 in a pattern.

Each breast cup 200 preferably has the inner layer 210 and the outer layer 230, with the spacer layer 220 therebetween, joined peripherally, thereby enclosing the spacer layer. The inner and the outer layers 210, 230 may be joined by any method known in the art including, but not limited to, sewing, gluing, riveting or ultrasonically connecting. Preferably, sewing is used so that a seam line 260 is formed as shown in FIGS. 1 and 6. In the most preferred embodiment, spacer layer 220 is molded, and then outer layer 230 and inner layer 210 are made of the power mesh fabric and are sewn about the spacer fabric.

The significant aspects of the process of making breast cups 200 of brassiere 100 are as follows. The spacer layer 220 is preferably molded to form the molded shape breast cups 200. This molding uses an impression mold that is heated to about 400 degrees Fahrenheit for about 50 to about 55 seconds.

Then, the molded spacer layer 220 is placed under a single headed device. This single headed device has an anvil or a cutter structure 300 as shown in FIG. 5, and a smooth horn (not shown) that mates with the anvil. In a preferred embodiment, the anvil 300 is stationary and the horn moves toward the anvil. When the horn moves in close proximity to anvil 300, a predetermined amount of ultrasonic energy is applied so that a desired pattern of perforations 226, preferably to form the flower pattern, is formed in each molded breast cup 200 as shown in FIGS. 1 through 3 and 6. Preferably, each flower is formed, e.g., cut into each molded breast cup 220, one at a time. Preferably, each pattern is cut individually, and then the breast cup 200 is rotated about 3 or about 4 times, which produces a number of patterns in each spacer layer 220 or breast cup 200.

The anvil 300 has a cutting edge or surface 305 with a cutting angle 310. The anvil 300 also has an emboss or embossing area 315, and an open area 320 that separates the cutting edge 305 from the embossing area. The open area 320 is about 1/64 inch to about 1/4 inch wide. Preferably, the open area 305 is about 1/64 inch wide. In a preferred embodiment, the cutting angle 310 is about 120 degrees. However, the cutting edge 305 will function with the cutting angle 310 in the range of about 80 degrees to about 170 degrees. It should be noted that the process of making breast cups 200 of brassiere 100 may be automated and controlled using software having program instructions. In the automated process of making breast cups 200 of brassiere 100, one or more anvils or cutter structures 300 may be on a roller (not shown) for improved assembly.

Known prior art perforation methods that employ single head cutters shear or fray an edge of the cut material. This leads to poor quality and it has been observed that this fraying will reduce the life of the garment. The anvil 300, with a cutting edge 305 having about a 120-degree angle, eliminates the shearing stresses induced by prior art cutters. Additionally, the open area 320 adds strength to molded spacer layer 220 during cutting by enlarging or "puffing up" around the pattern or area to be cut. Simultaneously, the embossing area 315 flattens the pattern of the molded spacer layer 220 holding the pattern taut, thereby assisting in providing a smooth, non-tearing or non-fraying, cut as shown in 227 in FIG. 6.

The horn to be used is preferably a coated slick horn. The horn contacts anvil 300 when perforating or forming the pattern in molded spacer layer 220, and cutting the pattern along edge 227. This coated slick horn employs a power booster and a converter. The converter turns an amount of power into a number of ultrasonic vibrations that treat the cut edge 227 with an ultrasonic frequency. The ultrasonic frequency is preferably in a range that includes about 10 kilohertz to about 50 kilohertz. This frequency vibration melts and seals cut edge 227. The anvil 300 therefore simultaneously perforates or forms the pattern and prevents, with the applied ultrasonic energy, the edge 227 cut edge from unraveling or tearing. Referring again to FIG. 6, the pattern has a series of perforations 226 and yet a finely defined edge 27 that is about 1/64 of an inch from the pattern or perforations 226.

The breast cups 200 are depicted here in the context of one form of brassiere. However, it is conceivable that breast cups 200 can be used for any garment or article of apparel, such as, but not limited to athletic brassieres, swimsuits, shirts, a coat, lingerie, or any other article of clothing being known in the art.

The present invention has been described with particular reference to the preferred embodiments. It should be understood that the foregoing descriptions and examples are only illustrative of the present invention. Various alternatives and modifications thereof can be devised by those skilled in the art without departing from the spirit and scope of the present invention. Accordingly, the present invention is intended to embrace all such alternatives, modifications, and variations that fall within the scope of the appended claims.

What is claimed is:

1. A brassiere for supporting a wearer's breasts comprising:

a pair of breast cups with each of said pair of breast cups connected to a central panel, said central panel being disposed between said pair of breast cups; and a pair of side panels, each being connected to a separate one of said pair of breast cups, wherein each of said pair of breast cups has a first fabric layer, a second fabric layer and a third fabric layer between said first fabric layer and said second fabric layer, said third fabric layer having an outer surface and an inner surface, wherein said third fabric layer provides breathability to the wearer's breasts and support to said pair of breast cups, and wherein said third fabric layer is a spacer fabric having a first side and a second side, said third fabric layer has a plurality of perforations that each have a cut edge that is melted.

2. The brassiere of claim 1, wherein said third fabric layer has a feature selected from the group consisting of a plurality of valleys, a plurality of dimples, and any combination thereof in a location thereon, and wherein said location is selected from the group consisting of said outer surface, said inner surface, both said outer surface and said inner surface, a portion of said outer surface, a portion of said inner surface, and any combinations thereof.

3. The brassiere of claim 1, wherein said plurality of perforations form a pattern, said pattern being visible through said first fabric layer.

4. The brassiere of claim 3, wherein said pattern is selected from the group consisting of a floral pattern, a flower, a plurality of flowers, a heart, a plurality of hearts, a spiral, a plurality of spirals, a free-form design, a message, a plurality of numbers, a plurality of letters, a logo, and any combinations thereof.

5. The brassiere of claim 1, wherein said third fabric layer has a feature selected from the group consisting of a plurality of dimples, a plurality of valleys, and any combinations thereof.

6. The brassiere of claim 1, wherein said third fabric layer is made from a material selected from the group consisting of a mono-filament material, a multi-filament material, a polyester, a microfiber, a cotton, a nylon, a spandex, a stretchable fabric material, a power mesh material, a multi-filament polyester spandex, a molded fabric material, a weft knit fabric, a warp knit fabric, and any combinations thereof.

7. The brassiere of claim 1, wherein said third fabric layer is connected between said first fabric layer and said second fabric layer, said third layer being connected by a method selected from the group consisting of sewing, gluing, riveting, molding, ultrasonic connection, a mechanical connection, and any combinations thereof.

8. The brassiere of claim 1, wherein said third fabric layer is connected peripherally to said first fabric layer and said second fabric layer, wherein said third fabric layer is substantially enclosed between said first fabric layer and said second fabric layer.

9. An article of clothing for covering a wearer's breasts comprising:

a first breast cup;

a second breast cup;

a center gore being between said first breast cup and a second breast cup, said first breast cup and said second breast cup having an outer layer of fabric; and a spacer fabric layer being connected to said outer layer of fabric when the article of fabric of clothing is positioned on the wearer, said spacer fabric layer being positioned between said outer fabric layer and the wearer's breasts, wherein said spacer fabric layer provides breathability to the wearer's breasts, and wherein said spacer fabric layer has a first side and a second side, said spacer fabric layer having a plurality of perforations on a location of said spacer fabric layer and a feature selected from the group consisting of a plurality of dimples, a plurality of valleys, and any combinations thereof.

10. The article of clothing of claim 9, wherein said spacer fabric layer has a first surface, said first surface facing the wearer's breasts, said first surface being substantially smooth relative to a second surface, said second surface being opposite said first surface.

11. The article of clothing of claim 9, wherein said plurality of perforations are on a portion of the spacer fabric layer that correspond to a location where the wearer's breasts lay, said plurality of perforations allowing a predetermined amount of air to substantially traverse through said spacer fabric layer, said predetermined amount of air being suitable to cool the wearer's breasts during exercise.

12. The article of clothing of claim 9, wherein said spacer fabric layer has a second feature selected from the group consisting of a concave surface, a convex surface, an aperture, a hole, and any combinations thereof.

13. The article of clothing of claim 12, wherein said second feature is formed in a pattern, said pattern being selected from the group consisting of a floral pattern, a flower, a plurality of flowers, a heart, a plurality of hearts, a spiral, a plurality of spirals, a free-form design, a message, a plurality of numbers, a plurality of letters, a logo, and any combinations thereof.

14. The article of clothing of claim 9, wherein said spacer fabric layer and said outer fabric layer are formed from a material being selected from the group consisting of a mono-filament material, a multi-filament material, a polyester, a microfiber, a cotton, a nylon, a spandex, a stretchable fabric material, a power mesh material, a multi-filament polyester spandex, a molded fabric material, a weft knit fabric, a warp knit fabric, and any combinations thereof.

15. A method of making an article of clothing, the method comprising the steps of:

molding a spacer layer into a pair of breast cups using a mold, said mold being heated to a temperature, said temperature being in a range that includes about 400 degrees Fahrenheit for a time period, said time period being in a range that includes about 50 to about 55 seconds;

positioning said spacer layer under a single headed device, said single headed device having an anvil and a horn, said anvil having a cutting edge and an embossing area;

mating said horn and said anvil with said spacer layer being between said anvil and said horn, said cutting edge cutting a pattern in said molded spacer layer by cutting a plurality of perforations in said spacer layer, each of said plurality of perforations of said pattern having an edge;

applying ultrasonic energy to said spacer layer so that said edge of each of said plurality of perforations of said pattern formed in said spacer layer is sealed; and stitching said spacer layer having said pattern between a first fabric layer and a second fabric layer, wherein said pattern is visible through at least one of said first fabric layer and said second fabric layer.

16. The method of claim 15, wherein said cutting edge and a surface of said anvil form an angle, said angle being in a range that includes about one hundred twenty degrees, said range for substantially eliminating a shear stress on said molded spacer fabric during said cutting.

17. The method of claim 15, wherein said ultrasonic energy has a frequency, said frequency being in a range that includes about 10 kilohertz to about 50 kilohertz.

18. The method of claim 15, wherein said horn has a coating being on said horn, and said mold is an impression mold.

19. The method of claim 15, further comprising the step of rotating said spacer layer when mating said horn with said anvil, said spacer layer being between said anvil and said horn, said rotation causing a plurality of patterns to be formed on said spacer layer.

* * * * *